United States Patent [19]

Arnold

[11] 4,045,031

[45] Aug. 30, 1977

[54] BOARD GAME APPARATUS

[76] Inventor: William Brenton Arnold, 21 W. Ivy Lane, Englewood, N.J. 07631

[21] Appl. No.: 660,817

[22] Filed: Feb. 24, 1976

[51] Int. Cl.[2] ..... A63F 3/00

[52] U.S. Cl. ..... 273/134 AT; 273/134 AD; 273/134 C; 273/134 D

[58] Field of Search ..... 273/134

[56] References Cited

U.S. PATENT DOCUMENTS

| | | | |
|---|---|---|---|
| 2,026,082 | 12/1935 | Darrow | 273/134 AT |
| 2,177,078 | 10/1939 | Raizen et al. | 273/134 AT |
| 3,734,508 | 5/1973 | Snyder | 273/134 AT |
| 3,951,411 | 4/1976 | Hill et al. | 273/134 AD |
| 3,970,313 | 7/1976 | Montemayor | 273/134 AD |

FOREIGN PATENT DOCUMENTS

| | | | |
|---|---|---|---|
| 915,550 | 1/1963 | United Kingdom | 273/134 AT |

*Primary Examiner*—Delbert B. Lowe
*Attorney, Agent, or Firm*—Samuelson & Jacob

[57] ABSTRACT

A game board has a system of courts where the outcome of lawsuits are determined and a continuous playing path around its edge. Chance devices direct movements of game pieces along the path, and indications on the path direct selection of cards relating to lawsuits.

Each player has the opportunity as determined by the chance devices of claiming a specific lawsuit as his own and thereby becomes the plaintiff of that lawsuit. Another player may become the defendant of that specific lawsuit by a determination of the chance devices. The outcome of different lawsuits and their penalties are determined by a system of courts, required legal fees, use of an expert witness, and operation of the chance devices.

7 Claims, 8 Drawing Figures

FIG 6

72
SMALL CLAIMS COURT
AUTOMOBILE MECHANIC CANNOT TELL A LIE IN COURT-ADMITS HE OVERCHARGED YOU
COLLECT $200

73
SMALL CLAIMS COURT
MOVING MAN DROPPED AUNT TILLY'S PORTRAIT
COLLECT $200 DAMAGES

74
SMALL CLAIMS COURT
MEAT MAN SELLS YOU HOT DOGS WITH NO MEAT
COLLECT $100 DAMAGES

75
SMALL CLAIMS COURT
WAITRESS SPILLED COFFEE IN YOUR LAP
COLLECT $500 DAMAGES

76
SMALL CLAIMS COURT
FOR NOT STANDING WHEN JUDGE ENTERED COURT ROOM
PAY $500
FOR CONTEMPT OF COURT

77
SMALL CLAIMS COURT
YOUR DOG BIT NEIGHBOR
PAY $100 DAMAGES

78
SMALL CLAIMS COURT
JUDGE LIKES YOU
COLLECT $500

79
SMALL CLAIMS COURT
FRIEND SLIPPED ON YOUR ICY SIDE-WALK
PAY $200 DAMAGES

80
SMALL CLAIMS COURT
YOU HIRED A LAWYER FOR A $50 SMALL CLAIMS COURT CASE. YOU WON CASE. HE DID 10 HOURS OF RESEARCH AT $60 per HOUR
PAY $600 LAWYER FEE

81
SMALL CLAIMS COURT
POLITICIAN LIED TO YOU
COLLECT $100 DAMAGES

82
SMALL CLAIMS COURT
DEMONSTRATORS OUTSIDE COURTROOM SWAY JUDGE TO YOUR SIDE
COLLECT $300

83
SMALL CLAIMS COURT
WITNESS SAW T.V MAN DROP YOUR SET
COLLECT $500 DAMAGES

84
SMALL CLAIMS COURT
COCKROACH WAS FOUND IN EGG OMELET YOU SERVED
PAY $300 DAMAGES

85
SMALL CLAIMS COURT
YOU BROKE SIX WINDOWS DURING BASEBALL GAME
PAY $200 DAMAGES

FIG 7

86

LAWYER FEE $2000

LAWYER
LAWSUIT

I AM SUING YOU FOR
NEGLIGENCE

YOU ACTED AS MY LAWYER IN MY LAST LAWSUIT.
YOU LOST MY CASE IN COURT

I CLAIM YOU DID NOT DO YOUR HOMEWORK IN PREPARATION FOR THE TRIAL AND THAT BECAUSE YOU WERE ILL PREPARED AND LAZY YOU CAUSED ME TO APPEAR SILLY IN COURT. I CLAIM THAT YOU WERE NEGLIGENT IN THE PERFORMANCE OF YOUR DUTIES AS A LAWYER. ESPECIALLY WHEN YOU MADE THE MISTAKE OF SAYING TO THE JUDGE "YOUR HONOR, I OBJECT, MY CLIENT IS GUILTY." WHEN YOU MEANT TO SAY "MY CLIENT IS INNOCENT"

I CLAIM YOU OWE ME
$20,000 FOR YOUR NEGLIGENCE

87

LAWYER FEE $2500

DOCTOR
LAWSUIT

I AM SUING YOU FOR
MEDICAL MALPRACTICE

I CAME TO YOU, A DOCTOR, AT LAST CHANCE HOSPITAL AND TOLD YOU THAT I WAS SURE I HAD STEPPED ON A NAIL BUT THAT IT MUST HAVE COME OUT. YOU BANDAGED MY FOOT AND GAVE ME A TETANUS SHOT. THREE DAYS LATER MY FOOT BECAME INFECTED AND I HAD TO GO TO A SURGEON. HE FOUND A TOOTH IN MY FOOT. I DON'T KNOW HOW A TOOTH GOT IN MY FOOT BUT REGARDLESS YOU DID NOT TREAT ME RIGHT. SINCE I AM IN POLITICS I NEED TO DO A LOT OF RUNNING AROUND AND MY FOOT HURTS. ALSO, I FIND IT HARD TO KICK MY FOOTBALL

I CLAIM YOU OWE ME
$25,000 FOR YOUR MALPRACTICE

88

LAWYER FEE $1000

BUBBLE GUM
LAWSUIT

I AM SUING YOU FOR FALSE
CLAIMS AND MISREPRESENTATION

I BOUGHT 4,000 BOXES OF BUBBLE GUM FROM YOU.
EACH BOX LISTED THE CONTENTS AS ONE POUND OF BUBBLE GUM.
WHEN I WEIGHED THE GUM THERE WAS ONLY ONE HALF POUND OF BUBBLE GUM IN EACH BOX.
I CLAIM THAT YOU OWE ME $10,000 BASED ON THE FACT THAT YOU, THE PRESIDENT OF THE BUBBLE GUM COMPANY MADE FALSE CLAIMS AND MISREPRESENTED THE CONTENTS OF YOUR BUBBLE GUM BOXES

I CLAIM YOU OWE ME
$10,000
FOR COMPENSATION

89

LAWYER FEE $1500

GARAGE MECHANIC
LAWSUIT

I AM SUING YOU FOR FAULTY
AND DANGEROUS REPAIR WORK

I BROUGHT MY BEAUTIFUL NEW SPORTS CAR INTO YOUR GARAGE BECAUSE IT SQUEAKED.

YOU SAID THAT IT JUST NEEDED A LITTLE ADJUSTMENT AND THAT EVEN THOUGH IT WAS A FOREIGN SPORTS CAR, A MECHANIC SUCH AS YOURSELF WOULD HAVE NO PROBLEM.
TEN DAYS LATER WHEN YOU HAD FINALLY FINISHED THE JOB YOU GAVE ME A BILL FOR $400.
ALTHOUGH I WAS UPSET AT THE CHARGES, I PAID YOU.
I DROVE THE CAR OUT OF YOUR GARAGE AND TWO BLOCKS AWAY THE WHEELS FELL OFF AND THE ENGINE FELL OUT. THE CAR THEN HIT A TREE AND IS A TOTAL LOSS.

I CLAIM YOU OWE ME
$15,000 FOR DAMAGES

FIG 8

91

LAWYER FEE $1500

NEWSPAPER REPORTER LAWSUIT

I AM SUING YOU FOR LIABLE, DAMAGED REPUTATION AND SLANDER

YOU WROTE A NEWSPAPER ARTICLE ABOUT ME.

IN THAT ARTICLE YOU SAID THAT I WAS FAT, USED NASTY WORDS AND THAT I ALWAYS HAD BAD BREATH. YOU ALSO SAID THAT I WAS CRAZY.

YOU ALSO REPEATED THOSE REMARKS IN FRONT OF MY ONLY FRIEND-MY DOG FERDINAN.

FERDINAN IS VERY UPSET NOW AND NO LONGER LIKES ME.

I CLAIM YOU SHOULD PAY ME $15,000 FOR DAMAGES AND THAT YOU RETRACT YOUR STATEMENT PUBLICLY.

92

LAWYER FEE $800

CAPTAIN OF THE SHIP LAWSUIT

I AM SUING YOU FOR POLLUTION OF MY BEACH.

YOU WERE THE CAPTAIN OF THE SHIP THAT DUMPED WASTE OIL OVERBOARD NEAR MY BEACH HOME.

THE RESULTING OIL SLICK RUINED THE BEACH BY MY HOUSE AND I HAD TO PAY $8,000 TO HAVE THE BEACH RESTORED.

I HAVE A SAMPLE OF THE OIL AND I'M GOING TO PROVE THAT YOU WERE THE CULPRIT.

I CLAIM YOU OWE ME $8,000 FOR DAMAGES

93

LAWYER FEE $3000

STOCKBROKER LAWSUIT

I AM SUING YOU FOR FRAUDULENT PROMISES

YOU ACTED AS MY STOCKBROKER. YOU TOLD ME THAT YOU WERE A GENIUS IN THE STOCK MARKET AND THAT ANY STOCK YOU BOUGHT FOR ME HAD TO GO UP IN VALUE.

YOU SAID THAT BECAUSE I WAS SUCH A GOOD FRIEND YOU WOULD GUARANTEE THAT IF THE STOCK YOU BOUGHT FOR ME DROPPED IN VALUE YOU WOULD GIVE ME BACK THE DIFFERENCE IN MONEY OUT OF YOUR OWN POCKET.

I GAVE YOU $30,000. THE COMPANY THAT YOU BOUGHT STOCK IN, FOR ME, WENT BANKRUPT AND I LOST EVERYTHING. YOU THEN LEFT TOWN. EVEN THOUGH YOU ARE NOW A TAXI DRIVER, I CLAIM THAT YOU STILL OWE ME $30,000

94

LAWYER FEE $2500

NEIGHBOR LAWSUIT

I AM SUING YOU, MY NEIGHBOR, FOR PERSONAL INJURY AND MENTAL ANGUISH

YOU INVITED ME OVER TO YOUR HOUSE FOR DINNER AND SOME FRIENDLY CONVERSATION, WHEN WE GOT INTO AN ARGUMENT OVER POLITICS. YOU GOT SO MAD AT ME THAT YOU LOST CONTROL OF YOUR TEMPER AND HIT ME IN THE MOUTH WITH YOUR FOOT.

AS A RESULT OF YOUR RASH ACTION I LOST 32 TEETH. MY SMILE IS NOW CROOKED AND I WORRY A LOT ABOUT IT.

YOUR STATEMENT THAT I LOST MY TEETH BECAUSE OF HOOF AND MOUTH DISEASE IS STUPID.

I CLAIM YOU SHOULD PAY ME $25,000 FOR DAMAGES

BOARD GAME APPARATUS

BACKGROUND OF THE INVENTION

This invention relates to board games and particularly to a board game involving the management of lawsuits in terms of money necessary for their continuance in a court system similar to the one used in the United States of America.

There is need for a board game which deals with lawsuits and their costs to the individual plaintiff and defendant. The number of lawsuits in the United States of America and other countries has been increasing as people become more aware of their rights under law and the danger of attempting to resolve grievances by means of physical retaliation. It is also significant that the law and court procedures are often so complex that a lawyer is necessary for fair representation in court.

Because one or more parties to a lawsuit may feel strongly about their innocence, be very angry, or be greedy, said parties may disregard their chances of winning in court or possibly refuse to accept reasonable offers of monetary settlement. These parties may incur huge fees which, even though they may win in court, will make them the financial loser.

One of the objects of this game is to make people aware of the monetary dangers in lawsuits in terms of legal fees and, to some degree, unreasonableness on their part. As the player becomes competitively involved in the game, he must make many decisions as to the likelihood of winning a lawsuit that he is in and whether he can afford, realistically, to try to win.

Thus, it is my hope that by playing the board game an educational value may be derived in terms of making the player more aware of monetary costs when involved in a lawsuit. And, should the player ever be involved in a real lawsuit, thereby possibly temper unwise legal moves based on anger, greed, stupidity, or, maybe, even his lawyer's desire for a fee.

SUMMARY OF THE INVENTION

Applicant chooses to call his game in the preferred embodiment "SUE SUE SUE". It is a board game for from two to six players although it is not limited to a maximum of six players. It is designed to provide each player with an opportunity to use chance and skill to sue another player with a fictional lawsuit and either settle said lawsuit out of court or pursue it through the game's court system. Payment of lawyer fees is required at certain stages of the game. The chance of winning in the lower court is influenced by certain variables such as the use of an expert witness, the ability to pay for a lawyer, and the operation of chance means such as the roll of dice. A party to a lawsuit may appeal a lower court decision to the Appeals Court or Supreme Court with the appealing party's chance of winning decreasing as he ascends the court system to the Supreme Court.

Each player begins the game with a sum of play currency, a token house, a token car, and a token stock certificate which are his assets that may be used to meet financial obligations incurred during the course of play.

During the course of play the player may be exposed to various situations, other than specific lawsuits, which reflect other type legal actions and monetary awards or penalties.

The winner of the game is the player with the highest net worth at the end of a time limit or when only one player is not bankrupt.

BRIEF DESCRIPTION OF THE DRAWING

FIG. 6 is a representation of a plurality of cards known as "Small Claims Court" cards.

FIG. 7 and FIG. 8 are representations of a plurality of "Lawsuit" cards and are otherwise known as first game elements.

Figure 1:
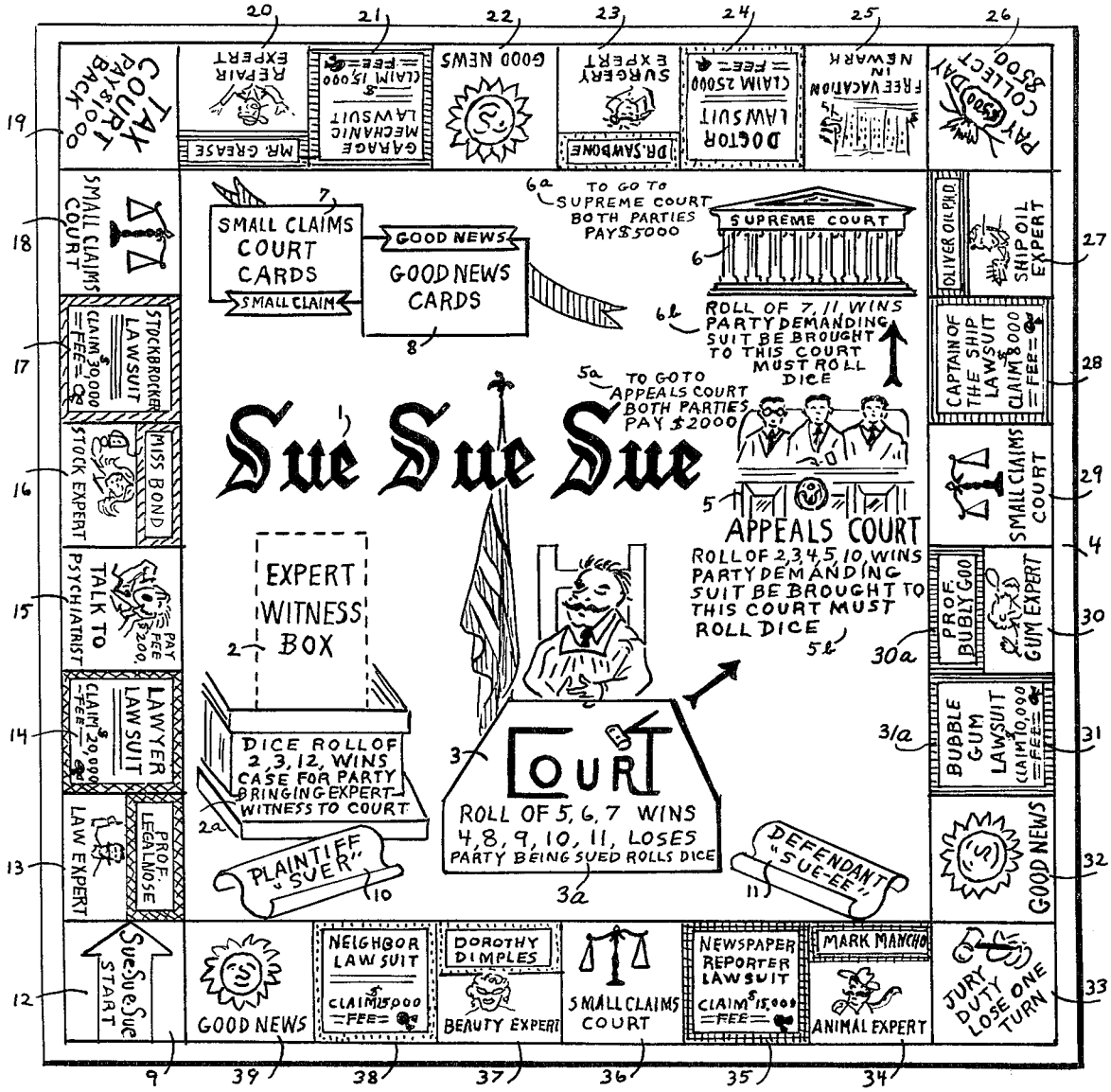
FIG. 1 is a plan view of one form or arrangement of board or playing field for the game, portions of which are suitably hatched according to the color symbols for draftsmen prescribed in 37 CFR 3.61.

While this invention is susceptible of embodiment in many different forms, there is shown in the drawings and will herein be described in detail a specific embodiment thereof, with the understanding that the present disclosure is to be considered as an illustrative example of the principles of the invention and is not intended to limit the invention to the embodiment illustrated.

DESCRIPTION OF A PREFERRED EMBODIMENT

In FIG. 1 there is a central area of the game board where 1 indicates the inventor's preferred name of this game. An expert witness box 2 indicates the location on the board where an "Expert" witness card is placed during an appearance in court for the purpose of influencing the outcome of a lawsuit trial. Instructions referring to the expert witness card are seen at 2*a*. The judge of the lower court is seen at 3, and instructions as to rules of play in his court are indicated at 3*a*. In FIG. 1, 4 incicates the right hand point where the game board will preferably be folded when not in use. In FIG. 1, 5 indicates the Appeals Court and 5*a* and 5*b* instructions pertaining to the rules of this court. The Supreme Court 6 has its court rules indicated by 6*a* and 6*b*. The common terms applied to the party instituting a lawsuit are listed at 10, and the common terms applied to the party against whom the lawsuit is instituted are listed at 11.

Figure 2:
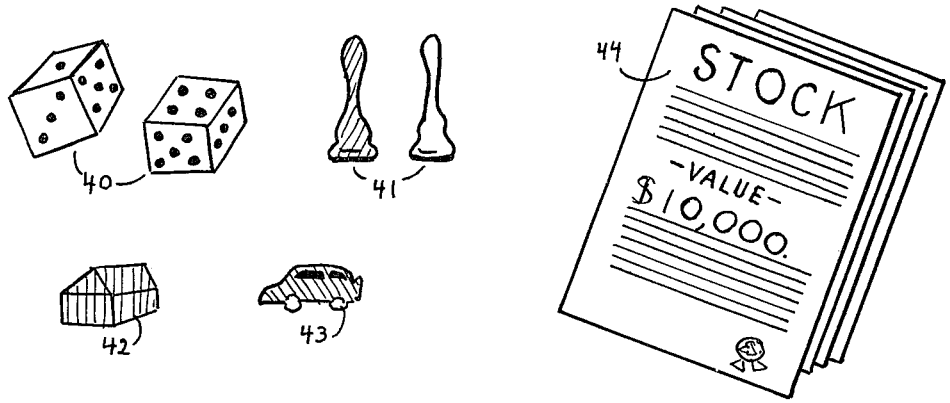
FIG. 2 is a view in elevation of a plurality of playing pieces for the various players including a pair of dice for registering movement of the players during the game.

Each player is provided with a movable playing piece such as is seen in FIG. 2 at 41 and is given a symbolic house 42, a symbolic car 43, and a stock certificate as is shown at 44. Means of chance such as dice are shown at 40.

Figure 4:
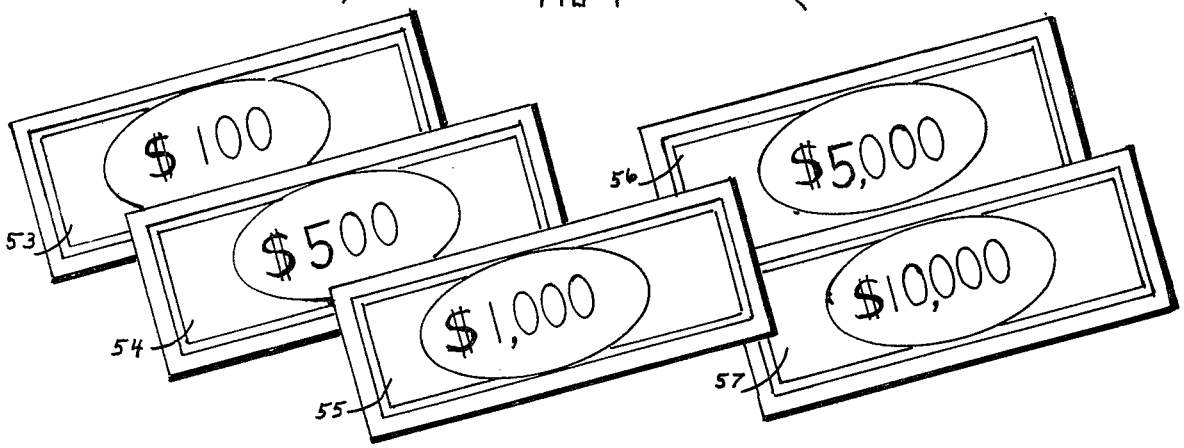
FIG. 4 is a representation of play money used in the board game.

In FIG. 4, 53, 54, 55, 56, 57 indicate play money for use in the game.

The game board (FIG. 1) has delineated thereon an outer play path 9 divided into a multiplicity of sequential areas numbered 12 through 39. The outer play path 9 has "Lawsuit" squares 14, 17. 21, 24, 28, 31, 35, 38 which correspond to "Lawsuit" cards representing them as shown in FIG. 7 at 86, 87, 88, 89, and in FIG. 8 at 91, 92, 93, and 94.

Figure 3:
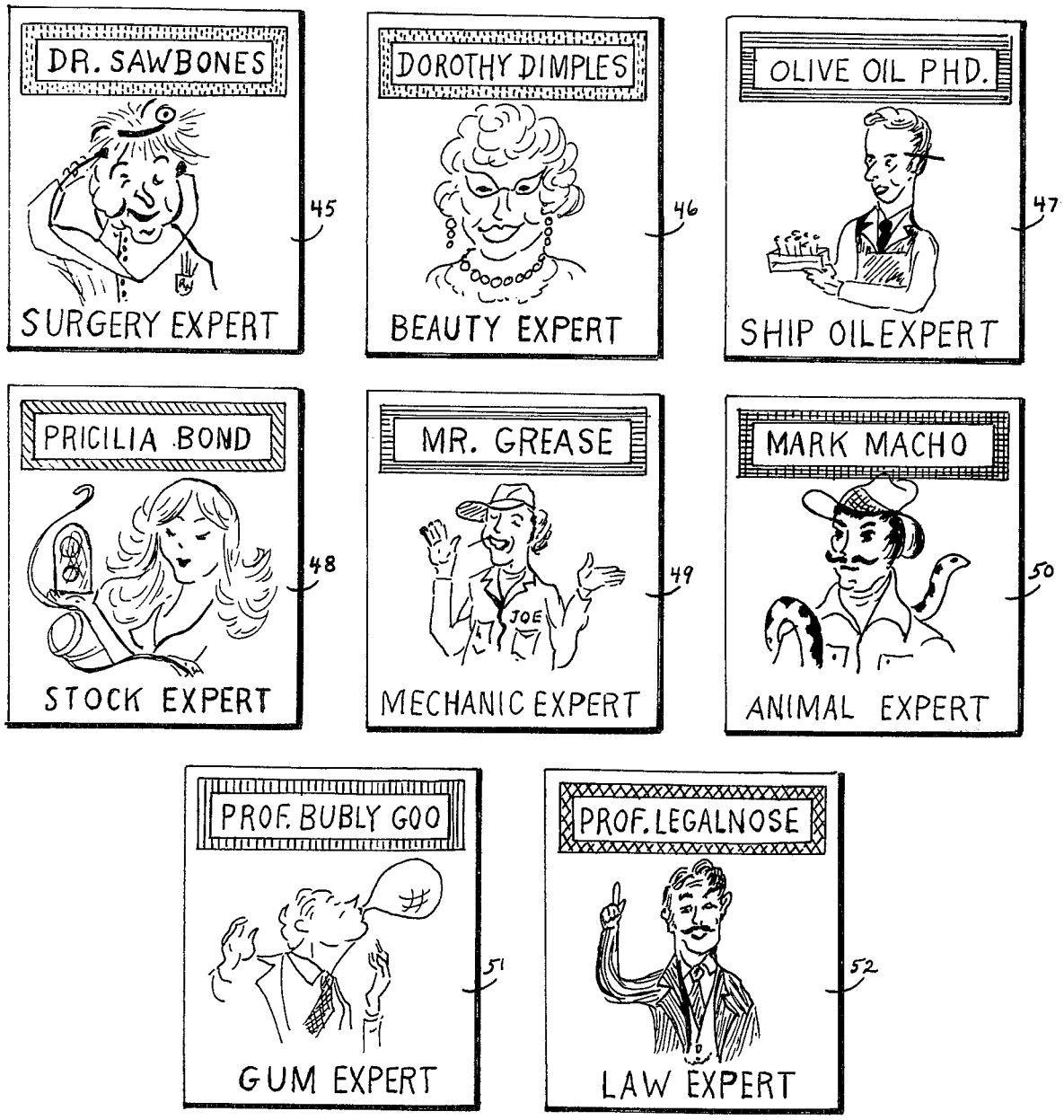
FIG. 3 is a representation of a plurality of cards known as "Expert" witness cards and are otherwise known as second game elements.

The outer play path 9 has Expert witness squares 13, 16, 20, 23, 27, 30, 34, 37 which correspond to "Expert"

witness cards seen in FIG. 3 at 45, 46, 47, 48, 49, 50, 51, and 52.

The outer play path 9 has four corner squares with 12 indicating the beginning of the play path, 19 indicating Tax Court, 26 indicating Pay Day, and 33 indicating Jury Duty. Each of these four corner squares has specific instructions.

The outer play path 9 has a Free Vacation square 25 and a Fee To Talk to Psychiatrist square 15.

Figure 5:
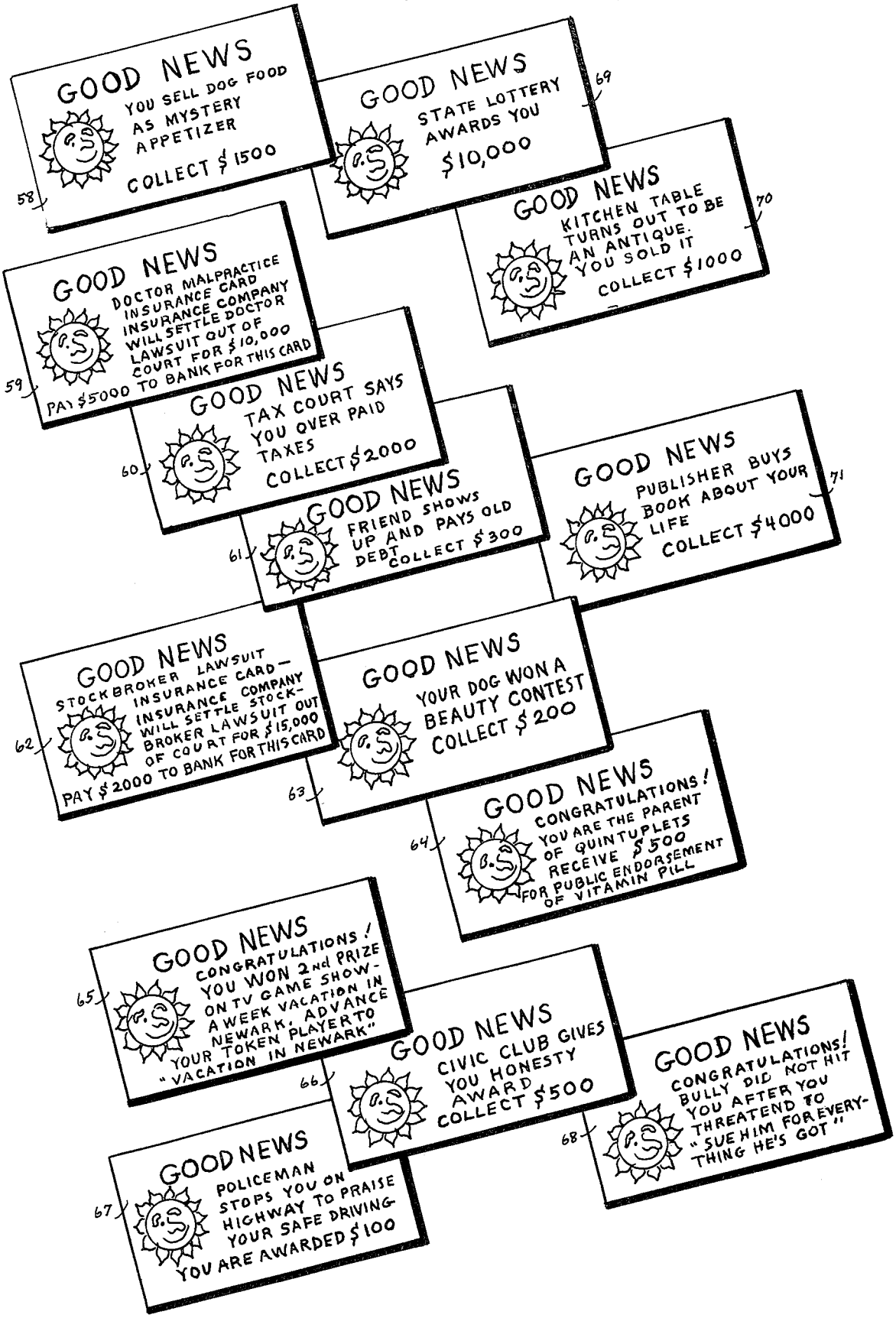
FIG. 5 is a representation of a plurality of cards known as "Good News" cards.

The outer play path 9 has three squares with a representation of the sun labeled Good News 22, 32, 39 which indicates that the player should take a card from the multiplicity of cards labeled Good News as seen in FIG. 5 at 58, 59, 60, 61, 62, 63, 64, 65, 66, 67, 68, 69, 70, and 71, which are stacked face down on the area indicated Good News cards in FIG. 1 at 8. The outer play path 9 has three squares with a representation of a scale as shown in FIG. 1 at 18, 29, and 36, which indicate that the player whose playing piece comes to rest on any one of those three squares should take a card from the multiplicity of cards labeled Small Claims Court as seen in FIG. 6 at 72, 73, 74, 75, 76, 77, 78, 79, 80, 81, 82, 83, 84, and 85, which are stacked face down on the area indicated Small Claims Court in FIG. 1 at 7.

It should be noted that on the outer play path 9 there is color coding of Expert witness squares and of Lawsuit squares. For the Expert witness square 30 there is a specific color code 30*a*. For the Lawsuit square 31 there is a specific color code 31*a*. It should be noted that the same color coding between a Lawsuit square and an Expert witness square indicates a relation between the two; that is, an expert witness of a given color coding is qualified to serve only in the lawsuit of the same color coding.

Each Expert witness square's color code is similarly represented on the Expert witness card related to it by such indications as title and content.

Each Lawsuit square's color code is similarly represented on the Lawsuit card related to it by such indications as title and content.

PLAY OF THE GAME

It is understood that the following description of the play of the game is the preferred embodiment of the rules of the game.

The competitive object of the board game is read to all players: "The object of SUE SUE SUE (preferred name) is to sue your fellow players with a lawsuit, pay the smallest amount of lawyer fees, and pay out the least amount of money when another player sues you.

You must make the best of a difficult situation in terms of money. The player with the largest net worth in terms of cash and cash value of assets at the end of the game is the winner.

The end of the game is determined by a time limit agreed upon by all players such as one, two, or three hours. The game's end may also occur when only one player is not bankrupt. Bankruptcy terminates a player's participation in the game.

EQUIPMENT

The equipment consists of the game board, 2 dice, 6 token players, 6 stock certificates, 6 houses, 6 cars, 8 Expert witness cards, 8 Lawsuit cards, Small Claims Court cards, and Good News cards.

PREPARATION

The game board is placed on a table, and the Small Claims Court cards and Good News cards are placed face down in their appropriate places in the upper left hand, central part of the board.

Each player receives the following at the beginning of SUE SUE SUE:

one house — value $50,000
one car — value $ 5,000
one stock certificate — value $10,000

Each player also receives $35,000 cash divided into $10,000 bills —1
$ 5,000 bills —4
$ 1,000 bills —3
$ 500 bills —3
$ 100 bills —5

BEGINNING THE GAME ANE ROLLING THE DICE

Each player rolls the dice. The highest roller starts the game, and the player to his left rolls next. Thus, a clockwise rotation of turns follows.

Each player has his own token player placed on the START SUE SUE SUE board position. When his turn comes to roll the dice, he moves this token player around the board the number of squares indicated by the dice. A person who rolls doubles moves his player to the appropriate square and consequences and then must roll again for another turn ahead of his fellow players until he stops rolling doubles.

BANK AND AUCTIONS

One player must volunteer to manage the bank. The bank holds all excess money and equipment including the pile of unclaimed Lawsuit cards and unclaimed Expert witness cards. The bank may print its own money if it runs out of funds.

The bank will at any time during the game buy certain assets of individual players even during a court case. The bank will pay one fifth the original value of these assets. Thus it will pay $10,000 for a house; $1000 for a car; or $2000 for stock. Once an asset is sold to the bank it cannot be bought back and becomes the property of the bank for the rest of the game.

A player may, however offer at any time these assets to the highest bidder among his fellow players. It is important to remember that the player at the end of the game is entitled to count the full value of any assets he may have bought at such an auction in computing his net worth. Thus, if a player buys a house for $15,000 from another player, that house is still valued at $50,000 at the end of the game.

EXPLANATION OF GAME BOARD SQUARES

If a player lands on a square distinctly marked as LAWSUIT, and no other player has claimed that lawsuit as his own by virtue of landing on it first, he may take it into his possession and thus become owner of that particular Lawsuit square. The player is then entitled to take the corresponding Lawsuit card from the pile of unclaimed Lawsuit cards to denote his possession of the claim capable of enforcement by that lawsuit.

Normally, no player may own more than two lawsuits at any one time. However, if he owns two lawsuits and then lands on a third which has not been claimed by another player, he may keep the lawsuit he just landed on provided he returns one of his original two back to the pile of unclaimed lawsuits.

Likewise, the player who lands first on an Expert witness square may claim that Expert witness as his and take it from the pile of unclaimed Expert witness cards, but there is no limit to the number of Expert witness cards that an individual player may claim.

If a person lands on SMALL CLAIMS COURT, he must take the top card from pile of Small Claims Court cards on the game board and comply with the decision of that court. Money is paid to or taken from the Bank for this court.

Landing on GOOD NEWS the player takes the top card from the pile of Good News cards on the game board. Money to be paid to him comes from the Bank. In this pile are two special insurance cards which, if he decides to keep one his own use, require payment to the Bank.

If the player lands on TAX COURT, he must pay $1000 to the Bank which is acting as agent for the government.

On landing on or passing PAY DAY, the player receives $500 from the Bank. This salary is given each time the player completes a trip around the board to once again arrive at or pass PAY DAY.

Landing on JURY DUTY results in the player losing one turn.

Landing on VACATION IN NEWARK is free, but landing on TALK TO PSYCHIATRIST requires payment of $200 to his agent, the Bank.

SUING ANOTHER PLAYER

If another player lands on a Lawsuit square that you own, you may sue him. He becomes a party in the lawsuit; namely, the Person being sued mentioned in that particular lawsuit.

The owner of the lawsuit, who is also a party in the lawsuit, will then read the charges of the lawsuit out loud (unless the lawsuit is known by all players) and then demand that the person being sued pay the money claimed. There are two ways to resolve this situation: 1. Go to court. or 2. Settle the case out of court. In SUE SUE SUE you do not need a lawyer to settle the case out of court.

SETTLING THE CASE OUT OF COURT

The person being sued may attempt to make a deal, otherwise known as a settlement, with the owner of the lawsuit in order to keep the lawsuit case from going to court. The person being sued may offer to pay the Lawsuit card holder any amount of money up to the amount demanded in the lawsuit card. In order to thus "Settle the case out of court" both players, the person doing the suing and the person being sued, must agree on the amount of settlement money to be given to the person doing the suing. At this point the bargaining ability of both players is tested. If a settlement cannot be agreed upon, then the person doing the suing says, See you in court, and the lawsuit case is taken to court.

LAWYER FEES

The Lawyer Fee is printed on the bottom of the Lawsuit square and card. For instance, in the Stock Broker lawsuit, the Lawyer Fee is $3000. The person doing the suing must pay $3000 as his lawyer's fee for representing him in court. Likewise, the person being sued must pay $3000 for his lawyer's legal fee.

The $3000 from each player is then put into a special pile of money kept at the Bank known as the Lawyers' Fee pile. All lawyer's fees for all lawsuits are kept in this pile.

For convenience it is not necessary to keep the lawyers' fees separate from the Bank's money, but if you do, it is interesting to see how much they made at the end of the game.

HIRING A LAWYER AND GOING TO COURT

Going to Court is expensive in terms of money that must be paid for a lawyer. In SUE SUE SUE you must have a lawyer to represent you in court.

If the person doing the suing pays his lawyer's fee, the lawsuit is in court.

It is important to remember that the person doing the suing must have enough cash money to pay his lawyer's fee. Failure on his part to raise money for a lawyer's fee in order to take the person being sued to court means that he is unable to sue, and the lawsuit is dropped. His lawsuit against another player is also automatically dropped if he cannot pay his lawyer's fee, when it is necessary for appearing in the Appeals Court or in the Supreme Court.

Should the person being sued not be able to pay any required lawyer's fee, the lawsuit case is automatically judged against him, and he is responsible for the full amount in the lawsuit claim. It may thus be seen that if a player being sued does not have enough money on hand to pay his lawyer's fee, he must immediately sell any assets to raise the cash, otherwise automatically lose his case in court.

THE JUDGE'S DECISION

Once both parties to a lawsuit have paid their lawyer's fee, the case comes before the judge. The Judge's Decision is determined by a roll of the dice. The person being sued rolls the dice. If he rolls 5, 6, and 7, the Judge declares him the winner, and that he does not have to pay the money claimed in the lawsuit.

If he rolls 4, 8, 9, 10, or 11, the Judge declares him the loser, and he must pay the money claimed in the lawsuit.

If he rolls, 2, 3, or 12, then the Party that brought the Expert witness to court wins the case.

EXPERT WITNESS

Either party to a lawsuit may increase his chance of winning in the lower court by bringing an Expert witness to court for his side.

There is only one Expert witness for each lawsuit, and that Expert witness is seen on the game board immediately to the right of the Lawsuit square and color coded the same as the Lawsuit square.

Any player in the game may claim an Expert witness simply by virtue of having landed on him first during the regular course of game play and thereby attaining the appropriate Expert witness card from the pile of unclaimed witnesses.

Whoever owns an Expert witness for a specific lawsuit must allow him to be used in court during a court trial.

However, who uses the Expert witness is decided by the highest bidder for him. Bidding starts at $100. The highest bidder pays the money to the owner of the Expert witness card.

If you own the Expert witness card and are one of the parties in the lawsuit, you need not offer him up for bid if you want to use him yourself.

The Expert witness card is always returned to the original owner after his use in court. If the Expert witness is not owned by any player, then the Bank receives the money for his temporary use in court, and the card is returned to the pile of unclaimed witnesses after court is over.

A roll of 2, 3, or 12 by the person being sued wins the case for whoever brought the Expert witness to court. If neither player wishes to bid on the use of the Expert witness' testimony in court, a roll of 2, 3, or 12 requires another roll to determine the winner of the case.

Even though a player wins his case by use of the Expert witness, his opponent may appeal the case to a higher court where the Expert witness is of no use.

APPEALING THE JUDGE'S DECISION

Either party to a lawsuit may seek to have the Judge's decision changed (reversed) by appealing the case to a higher court. If the lawsuit is appealed to a higher court, the payment of any money awarded by the (lower) Court Judge is suspended until the case has been finally decided in either the Appeals Court or the Supreme Court.

APPEALS COURT

Either party that does not like the Judge's decision may appeal the case to the Appeals Court. The case is in Appeals Court once the appealing party pays the required $2000 lawyer's fee.

If the other party fails to, or is unable to, pay $2000 for his lawyer to represent him in Appeals Court, the case is decided in favor of the one who originally brought the lawsuit to this court.

The party that brings the case to Appeals Court must roll the dice. He has about a 30% chance of winning and thereby reversing the lower court decision.

SUPREME COURT

Whoever lost in Appeals Court may wish to take the case to the Supreme Court for an absolutely final decision. If he pays the $5000 lawyer's fee, the case is now in the Supreme Court. His opponent must now also pay $5000 for a lawyer to be represented in Supreme Court, or automatically be declared the loser.

The party that brings the case to the Supreme Court must roll the dice. He has about a 20% chance of winning and thereby reversing the Appeals Court decision.

AN EXAMPLE OF HOW TO SUE ANOTHER PLAYER

Assuming that youe are the owner of the Stock Broker lawsuit and player X lands on this lawsuit square, you then read the lawsuit card to him and claim that he owes you $30,000.

Player X does not want to pay you $30,000, but he does not want to go to court either. Player X will offer you something less than the $30,000 that you claim. Perhaps, he will give you only $15,000 to settle the case and thereby avoid going to court.

If your take the $15,000, the lawsuit is over, and the next player takes his turn.

However, let us suppose you want at least $20,000 to settle, and player X will not give it to you.

You must then get a lawyer for yourself. His fee is indicated on the bottom of the Stock Broker's lawsuit card ($3000). You give this money to the Banker who puts it in the legal fee pile.

Player X must now pay a similar $3000 legal fee, or automatically the Court declares you the winner of the case because X chose not to appear in court with a lawyer.

Once you and X are in court the next step is to bid on the use of the case's specific Expert witness, Miss Bond. The highest bidder gets her use in court and improves his chance of winning. The player owning the Miss Bond Expert witness card gets the money bid for her use in court.

Let us assume that you have bid the most for the Expert witness, and she is on your side.

Player X now rolls the dice since he is being sued. He must roll 5, 6, or 7 to win. (If he had the Expert witness, he could have won also with a roll of 2, 3, or 12.)

Let us assume player X rolls a 6 and wins in court. Player X now owes you nothing unless you appeal the case to the Appeals Court.

Since it only costs you $2000 to take the case to Appeals Court, you decide it's worth a try in order to win the case there and collect $30,000. You pay $2000 in legal fees and force player X to pay $2000 for a lawyer, otherwise he would automatically lose in Appeals Court. You must roll the dice since you are the one appealing. You are lucky and win in Appeals Court, and now player X must pay you $30,000 unless he appeals to the Supreme Court. It will cost player X $5000 in legal fees, but he thinks it's worth a chance to avoid paying you $30,000. Therefore, X pays the $5000, and you must also hire a lawyer for $5000 or lose the case automatically. Since X is appealing the case to a higher court, he must roll the dice. X must roll a 7 or 11 to win the case in the Supreme Court and avoid paying you $30,000. Player X does not roll a 7 or 11, and now he must give you $30,000.

On summation it has cost you $10,000 in legal fees plus what you bid on the Expert witness to win $30,000. It has cost X $10,000 in legal fees and the $30,000 he must finally pay you. Player X would have been better off settling with you in the beginning for $20,000, but then again he might have won in the Supreme Court.

MISCELLANEOUS: INSURANCE CARDS

There are two insurance cards in the Good News deck.

The Malpractice insurance card protects you if you land on the Doctors lawsuit.

The Stock Broker insurance card protects you if you land on the Stock Broker lawsuit. The former costs $5000 and the latter $2000. The Bank acts as agent for the insurance company and accepts the fee for the card and pays out money when the card is used by the player to defend himself.

Either Good News insurance card will automatically offer a set amount of money, paid by the Bank, as settlement for the lawsuit. If this is accepted by the lawsuit owner, the case is settled out of court and therefore closed.

If the lawsuit owner will not accept this settlement, then the insurance company will pay all lawyer's fees for you to fight the case up to and including the Supreme Court.

If you lose in the Supreme Court, the Bank will pay the full amount of the claim against you.

Should you not wish to purchase the card when you turn it up in Good News, you simply decline and put it at the bottom of the deck. Otherwise, you may keep it until you use it once. Once used, return it to the bottom of the Good News deck. These cards cannot be sold or given to another player. If you go bankrupt, it is returned to the deck.

I claim:

1. Board game apparatus for playing a board game among a plurality of players, said board game apparatus comprising:

a playing board having a playing surface;

a central area on the playing surface, the central area displaying a representation of a court system including lower and higher courts arranged in a prescribed inner sequence of play proceeding from each lower court to a higher court in the court system;

movable playing pieces for representing the players on the playing surface;

a plurality of outer areas arranged sequentially on the playing surface around the central area and defining an outer path of travel of fixed increments for the playing pieces, some of the outer areas including representations of different fictional claims enforceable by a corresponding lawsuit and others of the outer areas including representations of imaginary people arbitrarily designated as experts in fields of endeavor related to the subject matter of the fictional lawsuit-enforceable claims, the representations being spaced along the outer path of travel;

first game elements each corresponding to a representation of a different fictional lawsuit-enforceable claim for denoting the possession by a particular player of a claim capable of enforcement by a corresponding lawsuit;

second game elements each corresponding to a representation of an expert for denoting the possession by a particular player of that expert for use as a witness in the related lawsuit;

chance means for operation by each player, in sequence, to determine the number of increments of movement of a corresponding playing piece along the outer path of travel, thereby determining possession among the players of the lawsuit-enforceable claims and the experts for use as witnesses, and establishing the parties to a lawsuit through chance location of a playing piece upon an outer area, and for operation by a party to a lawsuit to determine, by chance, the outcome of the lawsuit, once the lawsuit-enforceable claim is asserted in the court system, in accordance with the procedure prescribed by the inner sequence of play through the court system;

the central area including a specific location for the second game element corresponding to the expert in the field related to the subject matter of the lawsuit in the court system, whereby placement of the appropriate second game element by a party at the specific location engages the expert as a witness for that party to increase the chances of that party prevailing in the outcome of the lawsuit; and game pieces for representing assets of each player, the assets as represented by the game pieces to be transferred between players in accordance with the outcome of the lawsuits to which the players are parties.

2. The invention of claim 1 wherein:

the first game elements are color-coded;

the second game elements are color-coded; and the color-codes of the first and second game elements are matched such that a first game element corresponding to a particular lawsuit-enforceable claim exhibits a color which is the same as the color exhibited by a second game element corresponding to an expert in the field related to the subject matter of that particular lawsuit-enforceable claim.

3. The invention of claim 1 wherein:

the central area of the playing surface includes at least two further specific locations;

a stack of cards is provided for placement at each further specific location, the cards containing instructions which effect advantages and disadvantages for a player; and the outer areas include certain areas in the outer path of travel, said certain areas containing directions to a player whose playing piece comes to rest in such a certain area to draw a card from a stack at a further specific location, whereby the player obtains advantages and disadvantages in accordance with said instructions.

4. The invention of claim 1 wherein:

the representations of the different fictional lawsuit-enforceable claims on the playing surface of the playing board each include a title, content and color; and the first game elements comprise cards, each card containing a title, content and color matching the corresponding representation on the playing surface of the playing board.

5. The invention of claim 1 wherein:

the representations of the experts on the playing surface of the playing board each include a title, content and color; and the second game elements comprise cards, each card containing a title, content and color matching the corresponding representation on the playing surface of the playing board.

6. The invention of claim 1 wherein:

the representations of the different fictional lawsuit-enforceable claims on the playing surface of the playing board each include a title, content and color;

the first game elements comprise cards, each card containing a title, content and color matching the corresponding representation on the playing surface of the playing board;

the representations of the experts on the playing surface of the playing board each include a title, content and color;

the second game elements comprise cards, each card containing a title, content and color matching the corresponding representation of the playing surface of the playing board; and the color present in each representation of a lawsuit-emforceable claim is the same as the color present in the representation of the expert in the field of endeavor related to the subject matter of that lawsuit-enforceable claim.

7. The invention of claim 1 wherein the game pieces for representing assets include play money, token houses, token cars, and token stock certificates.

* * * * *